US010730164B2

(12) United States Patent
Xiao et al.

(10) Patent No.: US 10,730,164 B2
(45) Date of Patent: Aug. 4, 2020

(54) PROCESS OF FORMING AN ABRASIVE ARTICLE

(71) Applicants: SAINT-GOBAIN ABRASIVES, INC., Worcester, MA (US); SAINT-GOBAIN ABRASIFS, Conflans-Sainte-Honorine (FR)

(72) Inventors: Ji Xiao, Shanghai (CN); Aiyun Luo, Shanghai (CN); Ignazio Gosamo, Léglise (BE); Vivian Susek, Metz (FR)

(73) Assignee: SAINT-GOBAIN ABRASIVES, INC/SAINT-GOBAIN ABRASIFS, Worcester, MA (US)

( * ) Notice: Subject to any disclaimer, the term of this patent is extended or adjusted under 35 U.S.C. 154(b) by 125 days.

(21) Appl. No.: 15/849,270

(22) Filed: Dec. 20, 2017

(65) Prior Publication Data

US 2018/0178348 A1 Jun. 28, 2018

Related U.S. Application Data

(60) Provisional application No. 62/450,910, filed on Jan. 26, 2017.

(30) Foreign Application Priority Data

Dec. 26, 2016 (CN) ..... 2016 1 1222046

(51) Int. Cl.
*B24D 3/06* (2006.01)
*B24D 7/06* (2006.01)
(Continued)

(52) U.S. Cl.
CPC ..... *B24D 3/06* (2013.01); *B24D 5/06* (2013.01); *B24D 5/123* (2013.01); *B24D 7/06* (2013.01); *B24D 18/0009* (2013.01)

(58) Field of Classification Search
CPC .. B24D 3/10; B24D 3/06; B24D 7/066; Y10T 428/12931; Y10T 428/12806;
(Continued)

(56) References Cited

U.S. PATENT DOCUMENTS 2,506,556 A 5/1950 Ball et al.
2,800,753 A 7/1957 Hollstrom
(Continued)

FOREIGN PATENT DOCUMENTS

EP 0794850 B1 5/1999
JP 2007-245251 A 9/2007

OTHER PUBLICATIONS

International Search Report from PCT Application No: PCT/US2017/067683, dated Apr. 13, 2018, 3 pgs.

*Primary Examiner* — Pegah Parvini
(74) *Attorney, Agent, or Firm* — Abel Schillinger, LLP; Joseph Sullivan

(57) ABSTRACT

A process can include forming at least one precursor abrasive component on a core and infiltrating at least a portion of the precursor abrasive component. The precursor abrasive component can include a body including a metal bond matrix and abrasive particles. Infiltrating can be performed after forming the precursor abrasive component with an infiltrant material. The infiltrant material can include a metal element, an alloy or a combination thereof. In an embodiment, forming at least one precursor abrasive component can include simultaneously joining the precursor abrasive component to the core.

19 Claims, 9 Drawing Sheets

(51) Int. Cl.
*B24D 18/00* (2006.01)
*B24D 5/06* (2006.01)
*B24D 5/12* (2006.01)

(58) Field of Classification Search
CPC ..... Y10T 428/12847; Y10T 428/12896; Y10T 428/12986
See application file for complete search history.

(56) References Cited

U.S. PATENT DOCUMENTS

| | | | | |
|---|---|---|---|---|
| 4,556,403 | A | 12/1985 | Almond et al. | |
| 5,385,591 | A | 1/1995 | Ramanath et al. | |
| 5,471,970 | A | 12/1995 | Sakarcan | |
| 6,093,092 | A * | 7/2000 | Ramanath ..... | B24D 5/06 451/527 |
| 2010/0035530 | A1 | 2/2010 | Gosamo et al. | |
| 2013/0055645 | A1 | 3/2013 | Atkins et al. | |

* cited by examiner

PROCESS OF FORMING AN ABRASIVE ARTICLE

CROSS-REFERENCE TO RELATED APPLICATION

This Application claims priority under 35 U.S.C. § 119(e) to U.S. Provisional Patent Application No. 62/450,910, entitled "PROCESS OF FORMING AN ABRASIVE ARTICLE", by Ji XIAO, et al., filed Jan. 26, 2017, and Chinese Patent Application No. 201611222046.3, entitled "PROCESS OF FORMING AN ABRASIVE ARTICLE", by Ji XIAO, et al., filed Dec. 26, 2016, of which both applications are assigned to the current assignee hereof and incorporated herein by reference in their entireties.

FIELD OF THE DISCLOSURE

The present invention generally relates to a process for forming an abrasive article. More specifically, the present invention relates to a process of forming an abrasive article including at least one abrasive component and a core.

BACKGROUND

The construction industry utilizes a variety of tools for cutting and grinding of construction materials. Cutting and grinding tools are required to remove or refinish old sections of roads. Additionally, quarrying and preparing finishing materials, such as stone slabs used for floors and building facades, require tools for drilling, cutting, and polishing. Typically, these tools include abrasive segments bonded to a core, such as a plate or a wheel. Abrasive segments are typically formed individually and then bonded to the core by sintering, brazing, welding, and the like. Breakage of the bond between the abrasive segment and the core can require replacement of the abrasive segment and/or the core, resulting in down time and lost productivity. Additionally, the breakage can pose a safety hazard when portions of the abrasive segment are ejected at high speed from the work area. Industry continues to look for improved formation of abrasive tools.

SUMMARY

In an embodiment, a process can include forming at least one precursor abrasive component on a core, the precursor abrasive component including a body having a metal bond matrix and abrasive particles contained within the metal bond matrix; and infiltrating at least a portion of the body after forming.

In an embodiment, a process can include forming at least one precursor abrasive component on a core, the precursor abrasive component including a body having a metal bond matrix and abrasive particles contained within the metal bond matrix; forming at least one infiltrant portion including an infiltrant material while forming the at least one precursor abrasive component; and heating the at least one precursor abrasive component and the at least one infiltrant portion to infiltrate the precursor abrasive component with the infiltrant material and forming at least one abrasive component on the core.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

The following is generally directed to a process of forming an abrasive tool having at least one abrasive component bonded to a core. An abrasive component can be an abrasive segment or a continuous rim. In particular, the process can include a single pressing step that can allow formation of a plurality of precursor abrasive components on a core. The process may not necessarily require a separate step, such as laser welding, sintering, or brazing, to facilitate attachment of a component to a core. The process can include infiltrating at least one precursor abrasive component on the core to form an abrasive tool having at least one abrasive component bonded to the core. After reading the present disclosure, a skilled artisan would appreciate embodiments provide a streamlined process of forming abrasive tools. Furthermore, the process allows formation of abrasive tools that comply with safety standards, such as EN13236.2015 for blades in hand held applications. An exemplary abrasive tool can include a cut-off blade or core drill.

Figure 1:
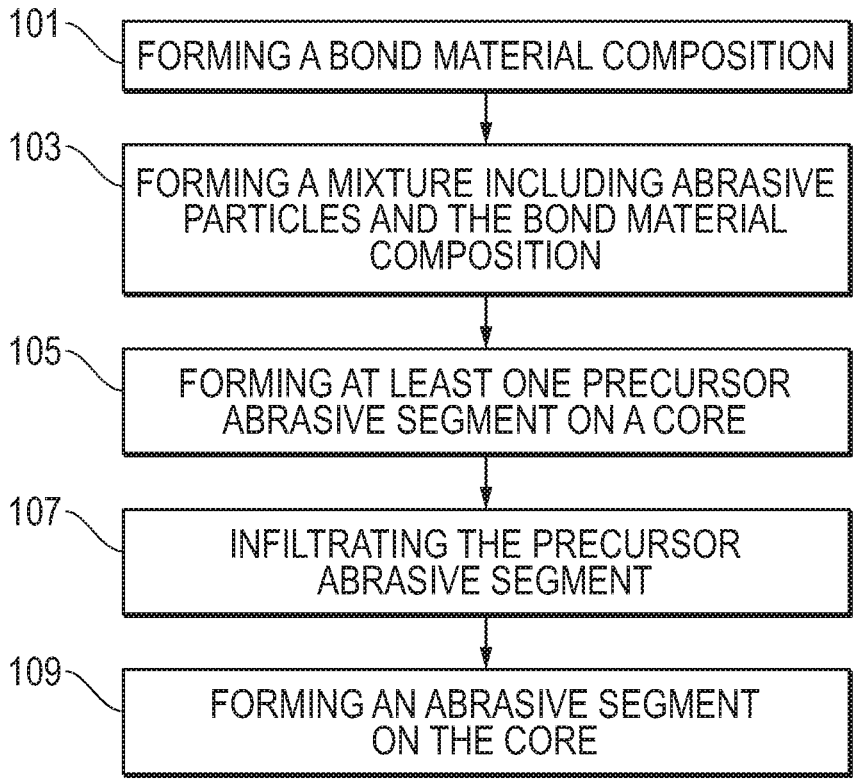
FIG. 1 includes a flow chart including a process in accordance with an embodiment.

FIG. 1 includes a flow chart illustrating a process for forming an exemplary abrasive article. The process can start at step 101, forming a bond material composition. The bond material composition can include a metal element, such as a transition metal element, an alloy, or a combination thereof. Exemplary metal element or alloy can include iron, iron alloy, tungsten, cobalt, nickel, chromium, titanium, silver, and any combination thereof. Alternatively, or additionally, the bond material composition can include a rare earth element, such as cerium, lanthanum, and neodymium. As desired in certain applications, the bond material composition can include a wear resistant component such as tungsten carbide. A skilled artisan would understand that a desired bond material composition may vary to suit different applications. According to an embodiment, the bond material composition can be in the form of powder. For instance, the bond material composition can include a blend of particles of individual components or pre-alloyed particles. The particles can be between 1.0 microns and 250 microns.

At step 103, a mixture including the bond material composition and abrasive particles can be formed. The abrasive particles can include a superabrasive, such as diamond, cubic boron nitride (CBN), or any combination thereof. In a particular embodiment, the superabrasive material can consist of diamond, cubic boron nitride (cBN), or any combination thereof.

In an embodiment, other materials, such as a filler, can be added to the mixture. Filler can be added to modify a property of the finally formed abrasive article or facilitate a forming process. For instance, filler including SiC, $Al_2O_3$, or the like can be added to improve wear resistance of the abrasive tool. In a further embodiment, filler can include graphite. Filler may or may not be present in the finally-formed abrasive article. Filler can be in the form of powder, granules, particles, or a combination thereof.

According to an embodiment, the mixture can include filler in a content that can facilitate improved formation of an abrasive article. For instance, filler can have a content of at least 0.5 wt. % for the total weight of the mixture, such as at least 1.5 wt. %, at least 2.5 wt %, or at least 4 wt. %. In another instance, filler can have a content of at most 12 wt. % for the total weight of the mixture, such as at most 11 wt. %, at most 9 wt. %, or at most 7.5 wt. %. In a further embodiment, the content of filler can be in a range including any of the minimum or maximum percentages noted herein. For instance, the mixture can include a filler content of at least 0.5 wt % and at most 12 wt. %.

According to an embodiment, the mixture can include the bond material composition in a content that can facilitate improved formation of an abrasive article. For example, the mixture can include at least 20 wt. % of the bond material composition for a total weight of the mixture, such as at least 25 wt. %, at least 31 wt. %, at least 38 wt. %, at least 44 wt. %, at least 49 wt. %, or at least 53 wt. %. In another example, the mixture can include at most 65 wt. % of the bond material composition for a total weight of the mixture, such as at most 59 wt. %, at most 51 wt. %, at most 48 wt. %, or at most 44 wt. %. After reading the instant disclosure, a skilled artisan would understand that the content of the bond material composition may vary as desired by different applications. In a further example, the mixture can include at least 20 wt. % and at most 65 wt. % of the bond material composition for a total weight of the mixture.

According to an embodiment, the mixture can include abrasive particles in a content that can facilitate improved formation of an abrasive article. For example, the mixture can include at least 5 wt. % of abrasive particles for a total weight of the mixture, such as at least 8 wt. %, at least 11 wt. %, at least 18 wt. %, at least 24 wt. %, at least 29 wt. %, or at least 33 wt. %. In another example, the mixture can include at most 55 wt. % of abrasive particles for a total weight of the mixture, such as at most 49 wt. %, at most 41 wt. %, at most 38 wt. %, or at most 34 wt. %. After reading the present disclosure, a skilled artisan would also understand that that the content of abrasive particles may vary as desired by different operations. In a further embodiment, the mixture can include at least 5 wt. % and at most 55 wt. % of abrasive particles for a total weight of the mixture.

In an embodiment, the abrasive particles can have an average particle size that can facilitate improved formation of an abrasive article. For example the average particle size can be at least 30 microns, such as at least 35 microns, at least 40 microns, at least 45 microns, at least 50 microns, at least 55 microns, at least 60 microns, at least 70 microns, at least 80 microns, at least 85 microns, at least 95 microns, at least 100 microns, at least 125 microns, at least 140 microns, or at least 180 microns. In another embodiment, the abrasive particles can have an average particle size of at most 900 microns, such as at most 860 microns, at most 750 microns, at most 700 microns, at most 620 microns, at most 500 microns, at most 450 microns, at most 400 microns, at most 350 microns, at most 280 microns, or at most 250 microns. It is to be appreciated that the abrasive particles can have an average particle size within a range including any of the minimum and maximum values disclosed herein. For instance, the average particle size of the abrasive particles can be within a range including at least 30 microns and at most 900 microns. Abrasive particle size can vary depending on applications of the abrasive articles. For example, coarse abrasive particles may be desired for certain applications requiring abrasive particles including diamond.

At step 105, forming at least one precursor abrasive component, such as a precursor abrasive segment or a continuous rim, on a core can be performed. As used herein, precursor is intended to describe an article or a part of an article that is not finally formed. A precursor abrasive component can be understood to be an uninfiltrated abrasive component. According to an embodiment, forming at least one precursor abrasive component on a core can include shaping the mixture obtained at step 103 into a body and simultaneously joining the body to a core. In an embodiment, a shaping device capable of providing a desired shape, such as a mold, can be used. The mixture can be disposed in a mold, and for instance, in a region that has the desired shape for an abrasive segment or a continuous rim. In some applications, the mold can include a plurality of segments to facilitate shaping and forming a plurality of precursor abrasive segments.

According to another embodiment, a core can be placed in the mold and in contact with the mixture. Depending on the application, a core can be in the form of a ring, a ring section, a plate, a cup wheel body, or a disc, such as a solid metal disk. A core can include heat treatable steel alloys, such as 25CrMo4, 75Cr1, C60, steel 65Mn, or similar steel alloys for cores with thin cross sections or simple construction steel like St 60 or similar for thick cores. A core can have a tensile strength of at least about 600 $N/mm^2$. A suitable core can be formed by a variety of metallurgical techniques known in the art.

According to another embodiment, a pressure can be applied to the mixture to facilitate shaping and joining the precursor abrasive component to the core. According to an embodiment, forming at least one precursor abrasive component on a core can include a single operation of pressing. Pressing can include hot pressing, cold pressing, isostatic pressing, or the like. In a particular embodiment, pressing can include cold pressing. Unlike certain conventional processes, cold pressing can be performed to shape the mixture into at least one precursor abrasive component having a green body and simultaneously join the green body directly to the core to form an abrasive article preform. The term, green, as used herein to describe a body, is intended to refer to a body that is not finally formed. For instance, a green body can be understood to be an uninfiltrated body of a precursor abrasive component. More particularly, forming at least one precursor abrasive component on a core can include a single operation of cold pressing. In a particular embodiment, a single cold pressing operation can be performed to form a precursor continuous rim on a core and simultaneously join the rim directly to the core. In another particular embodiment, a single cold pressing operation can be performed to form a plurality of precursor abrasive segments and simultaneously join the plurality of abrasive segments directly to the core.

Figure 2:
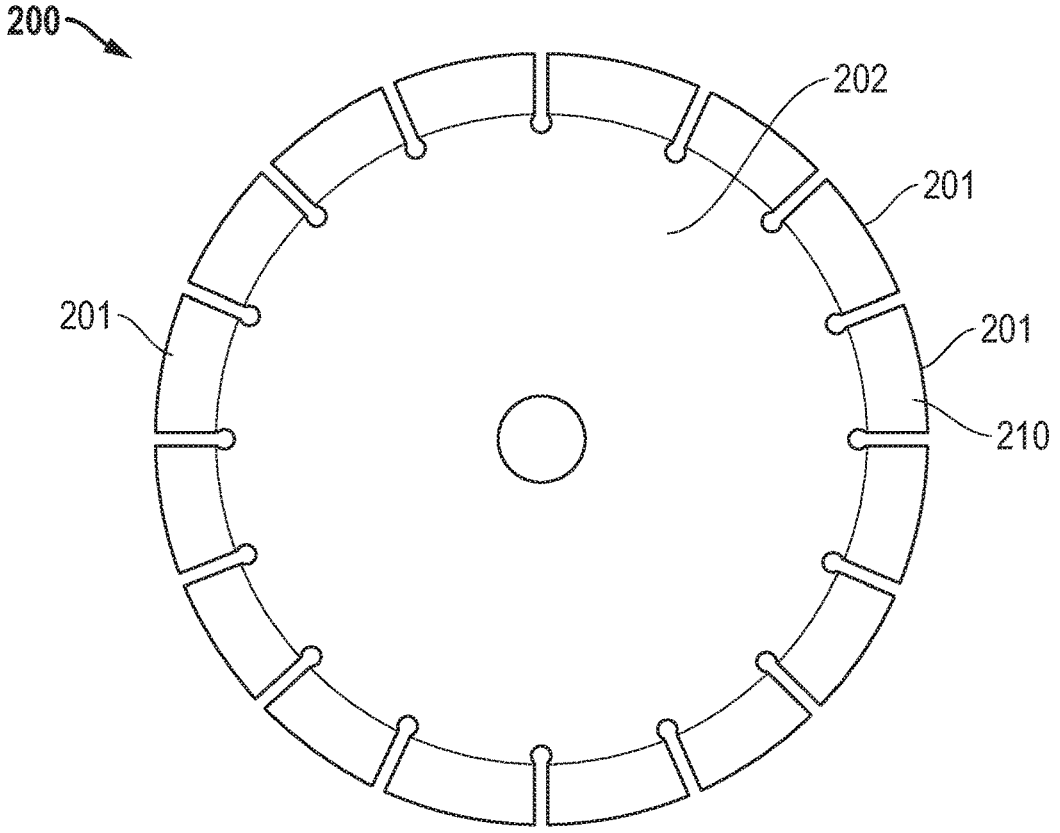
FIG. 2 includes an illustration of an exemplary abrasive article preform in accordance with an embodiment.

FIG. 2 includes an illustration of an exemplary abrasive article preform 200 including a plurality of precursor abrasive segments 201 directly attached to a core 202. Each precursor abrasive segment 201 can include a body 210.

According to at least one embodiment, pressing, such as cold pressing, can be carried out at a certain pressure that can facilitate improved formation of an abrasive article. For instance, the pressure can be at least 100 MPa, at least 200 MPa, at least 300 MPa, at least 400 MPa, at least 500 MPa, at least 700 MPa, or at least 900 MPa. In another instance, pressing can be performed at a pressure of at most 3000 MPa, such as at most 2800 MPa, at most 2500 MPa, at most 2250 MPa, at most 1850 MPa, or at most 1500 MPa. It is to be appreciated pressing can be performed at a pressure in a range including any of the minimum and maximum values disclosed herein. For instance, pressing can be performed at a pressure including at least 100 MPa and at most 3000 MPa, such as in a range including at least 700 MPa and at most 2250 MPa, or in a range including at least 900 MPa and at most 1850 MPa. In another embodiment, pressing can be performed at a pressure including at least 100 MPa and at most 1500 MPa.

According to at least one embodiment, pressing, such as cold pressing, can be carried out at a temperature that can facilitate improved formation of an abrasive article. For instance, pressing can be performed at a temperature of at most 200° C., at most 165° C., at most 115° C., or at most 50° C. In another instance, the temperature can be at least 10° C. It is to be appreciated pressing can be performed at a temperature in a range including any of the minimum and maximum values disclosed herein. For instance, pressing can be performed at a temperature in a range including at least 10° C. and at most 200° C., such as in a range including at least 15° C. and at most 50° C. According to at least one embodiment, pressing can be performed in an ambient atmosphere, a reducing atmosphere, or an inert atmosphere. In a particular embodiment, pressing can be performed at room temperature (e.g., 15° C. to 32° C.). and in ambient atmosphere.

According to an embodiment, a precursor abrasive component can include a green body having a metal bond matrix and abrasive particles contained within the metal bond matrix. The metal bond matrix can include any bond material composition disclosed herein. In a particular embodiment, the metal bond matrix can include a bond material composition including Cu, Sn, Ni, carbonyl iron, or a combination thereof.

According to a particular embodiment, the metal bond matrix can include a bond material composition that may be represented by the formula $(WC)_wW_xFe_yCr_zX_{(1-w-x-y-z)}$, wherein $0 \le w \le 0.8$, $0 \le x \le 0.7$, $0 \le y \le 0.8$, $0 \le z \le 0.05$, $w+x+y+z \le 1$, and X can include other metals such as cobalt and nickel. According to another particular embodiment, the metal bond matrix can include a bond material composition represented by the formula $(WC)_wW_xFe_yCr_zAg_vX_{(1-v-w-x-y-z)}$, wherein $0 \le w \le 0.5$, $0 \le x \le 0.4$, $0 \le y \le 1.0$, $0 \le z \le 0.05$, $0 \le v \le 0.1$, $v+w+x+y+z \le 1$, and X can include other metals such as cobalt and nickel.

According to another embodiment, the precursor abrasive component can include a green body having a certain porosity that can facilitate improved formation of an abrasive article. In an example, the precursor body can have a porosity of at least 10% for a total volume of the body, such as at least 13 vol %, at least 20 vol %, at least 28 vol %, at least 34 vol %, at least 42 vol %, at least 48 vol %, or at least 50 vol %. In another example, the precursor body can include a porosity of at most 50 vol % for a total volume of the body, such as at most 46 vol %, at most 43 vol %, at most 38 vol %, at most 33 vol %, at most 28 vol %, or at most 20 vol %. It is to be understood that the porosity of the precursor body can be in a range including any of the minimum and maximum percentages disclosed herein. For instance, the porosity can be between 10 vol % and 50 vol %. According to another embodiment, a precursor abrasive component can include a body including a network of interconnected pores.

Figure 3:
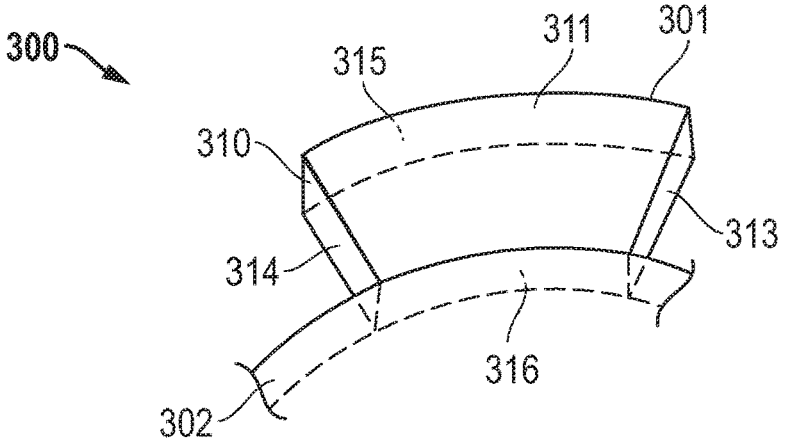
FIG. 3 includes an illustration of a portion of an exemplary abrasive article preform in accordance with an embodiment.

Referring to FIG. 1, the process can continue to step 107, infiltrating at least a portion of the at least one precursor abrasive component body. According to an embodiment, infiltrating can include applying an infiltrant material to at least a portion of the body, a portion of the core, or a portion of both. FIG. 3 includes an illustration of a portion of an abrasive article preform 300. A precursor abrasive segment 301 is attached to a core 302. The precursor abrasive segment 301 includes a body 310, and the body 310 includes a top surface 311, side surfaces 313 and 314, an outer peripheral surface 315, and an inner peripheral surface 316. The infiltrant material can be applied to any surfaces of the body, as long as the infiltrant material is in contact with the body. For instance, the infiltrant material can be applied to the top surface 311 for ease of application.

In an embodiment, the infiltrant material can include a metal, a metal alloy, or a combination thereof. Particularly, the infiltrant material can consist essentially of a metal, metal alloy, or a combination thereof. Exemplary metal can include a transition metal element, an alloy including a transition metal element, or a combination thereof. In a particular embodiment, the infiltrant material can include Zn, Sn, Cu, Ag, Ni, Cr, Mn, Fe, Al, or any combination thereof. For instance, the infiltrant material can include copper, and in certain applications, the infiltrant material can be pure copper. In another example, the infiltrant material can include Ag, Ni, Cr, or a combination thereof. In a further example, an infiltrant material can include a brazing alloy, such as NiCr, or an alloy including at least one of Cu, Ag, Sn, and Ti.

In an exemplary embodiment, the infiltrant material can include a copper-tin bronze, a copper-tin-zinc alloy, or any combination thereof. Particularly, the copper-tin bronze may include a tin content not greater than 20 wt. %, such as not greater than 35 wt. %. In some instance, the copper-bronze may not include tin. Further, the tin content in the copper-tin bronze may be at least 1 wt. %, such as at least 3 wt. %. Similarly, the copper-tin-zinc alloy may include a tin content not greater than 20 wt %, such as not greater than 15 wt %. Alternatively or additionally, the tin content in the copper-tin-zinc alloy may be at least 1 wt. %, such as at least 3 wt. %. The copper-tin-zinc alloy may include a zinc content not greater than 2 wt %, such as not greater than 1 wt. %. The zinc content in the copper-tin-zinc alloy can be at least 0.5 wt. %, such as at least 2 wt. %.

According to a further embodiment, the infiltrant material may include an alloy including at most 50 wt. % of tin for the total weight of the alloy, such as at most 45 wt. %, at most 40 wt. %, or at most 35 wt. %. In another embodiment, the infiltrant material may not include tin. For instance, the infiltrant material can include an alloy including 0 wt. % to 50 wt. % of tin. In another embodiment, the infiltrant material can include an alloy including zinc in a content of at most 20 wt. % of the total weight of the alloy. In still another embodiment, the infiltrant material may not contain zinc. In a further embodiment, the infiltrant material can include an alloy including 0 wt. % to 20 wt. % of zinc.

According to a further embodiment, the infiltrant material can have a melting point of at least 580° C., such as at least 600° C., at least 720° C., at least 860° C., or at least 950° C.

In another embodiment, the melting point of the infiltrant material may be not greater than 1200° C., such as not greater than 1200° C., not greater than 1120° C., not greater than 1030° C., not greater than 980° C. In a further embodiment, the infiltrant material can have a melting point between 580° C. and 1200° C.

In an embodiment, the infiltrant material can include powder. In another embodiment, the infiltrant material can be massive alloy. For instance, the infiltrant material can be a sheet of metal. In still another embodiment, the infiltrant material can be formed by cold pressing a powder of desired metal components. The powder can include particles of individual components or pre-alloyed particles. The particles can have a size of not greater than about 100 microns. Alternatively, the infiltrant material may be formed by other metallurgical techniques known in the art.

According to an embodiment, a heat can be applied to at least a portion of the body of the precursor component to facilitate infiltrating. In some embodiments, the abrasive article preform can be heated. Heating can be carried out in a furnace, such as a batch furnace or a tunnel furnace. Heating can be performed after the infiltrant material is applied and maintained until infiltration is completed. According to an embodiment, heating can be performed for at least 5 minutes to at most 10 hours.

Heat can be applied at a temperature that can facilitate infiltrating. For instance, heating can be performed at a temperature at least the melting point of the infiltrant material but below the melting point of the metal bond matrix and the core. For example, heating can be performed at a temperature of at least 600° C., such as at least 700° C., at least 800° C., at least 860° C., at least 900° C., at least 920° C., at least 960° C., or at least 1000° C. In another instance, heating can be performed at a temperature at most of 1320° C., such as at most of 1260° C., at most of 1180° C., at most of 1120° C., or at most of 1050° C. It is to be understood that heating can be performed at a temperature including any of the minimum and maximum values noted herein. For example, heat can be applied at a temperature in a range including at least 600° C. and at most 1350° C., such as in a range including at least 860° C. and at most of 1320° C., in a range including at least 900° C. and at most of 1260° C., in a range including at least 920° C. and at most of 1180° C., in a range including at least 960° C. and at most of 1120° C., or in a range including at least 980° C. and at most of 1050° C.

According to another embodiment, heating can be performed in a reducing atmosphere, an inert atmosphere, or an ambient atmosphere. Typically, reducing atmosphere can contain an amount of hydrogen to react with oxygen.

According to an embodiment, as the infiltrant material melts, the liquid infiltrant material can be drawn into pores of the precursor abrasive component, such as through capillary action. The infiltrant material can infiltrate and substantially fill the pores, forming an abrasive component. According to an embodiment, the abrasive component can have a densified body. The body can have a porosity of at most 5 vol %, such as at most 4 vol %, or at most 3 vol % for a total volume of the body. According to another embodiment, the porosity of the abrasive component body can be greater than 0, such as at least 0.001 vol % or at least 0.005 vol % for a total volume of the body. In a further embodiment, the abrasive component body may have a porosity of 0 vol %.

According to an embodiment, the abrasive component can include a body including abrasive particles embedded in the metal bond matrix. The metal bond matrix can have a network of interconnected pores or pores that are partially or substantially fully filled with the infiltrant material. A bonding region can be between the core and the abrasive component and include the infiltrant material.

According to an embodiment, the abrasive component can include a body including a certain content of the metal bond matrix that can facilitate improved formation of an abrasive article. For instance, the content of the metal bond matrix can be at least 15 vol % for a total volume of the body, such as, at least 18 vol %, at least 20 vol %, at least 25 vol %, at least 27.5 vol %, at least 35 vol %, or at least 40 vol %. In another instance, the abrasive component body can include the content of the metal bond matrix of at most 60 vol % for a total volume of the body, such as at most 52 vol %, at most 48 vol %, or at least 40 vol %. It is to be understood that an abrasive component can include a body including the metal bond matrix in a content including the minimum and maximum percentages included herein. For instance, the metal bond matrix can be present in the body of an abrasive component in a range including at least 15 vol % and at most 60 vol % for a total volume of the body.

According to another embodiment, the body can include a content of the metal bond matrix of at least 15 wt. % for a total weight of the abrasive component, such as at least 20 wt. %, at least 22 wt. %, or at least 25 wt. %. In another embodiment, the abrasive component body can include a content of the metal bond matrix of at most 45 wt. % for a total weight of the abrasive segment, such as at most 40 wt. %, at most 35 wt. %, or at most 30 wt. %. It is to be understood that an abrasive component can include a body including the metal bond matrix in a content including the minimum and maximum percentages included herein. For instance, the metal bond matrix can be present in the body of an abrasive segment in a range including at least 15 wt. % and at most 45 wt. % for a total weight of the body.

According to an embodiment, the body of an abrasive component can include a certain content of abrasive particles that can facilitate formation of an abrasive article with improved property and/or performance. For instance, abrasive particles can be present in an amount of at least 2 vol % for a total volume of the body, such as at least 8 vol %, at least 12 vol %, at least 18 vol %, at least 21 vol %, at least 27 vol %, at least 33 vol %, at least 37 vol %, or at least 42 vol %. In another example, abrasive particles can be present in an amount of at most 50 vol %, such as at most 42 vol %, at most 38 vol %, at most 33 vol %, at most 28 vol %, or at most 25 vol %. Abrasive particles can be present in the body of an abrasive component in a content including any of the minimum and maximum percentages disclosed herein. For instance, abrasive particles can be in a content between 2 vol % to 50 vol %. Additionally, the content of abrasive particles may depend on the application. For example, an abrasive component of a grinding or polishing tool can include between 3.75 and 50 vol % abrasive particles for the total volume of the component body. Alternatively, an abrasive component of a cutting tool can include between 2 vol % and 6.25 vol % abrasive particles for the total volume of the component body. Further, an abrasive component for core drilling can include between about 6.25 vol % and 20 vol % abrasive particles for the total volume of the component body.

According to another embodiment, the body of an abrasive component can include a content of the abrasive particles of at least 2 wt. % for a total weight of the abrasive component, such as at least 5 wt. %, at least 7 wt. %, or at least 10 wt. %. In another embodiment, the abrasive component body can include a content of the abrasive particles of at most 15 wt. % for a total weight of the body, such as at most 10 wt. %, at most 7 wt. %, or at most 5 wt. %. In a further embodiment, the abrasive component body can include a content of the abrasive particles in a range of at least 2 wt. % and at most 15 wt. % for a total weight of the component body.

According to another embodiment, the body of an abrasive component can include a certain content of the infiltrant material that can facilitate formation of an abrasive article with improved property and/or performance. For instance, the body can include at least 15 vol % of the infiltrant material for the total volume of the body, such as at least 20 vol %, at least 25 vol %, or at least 30 vol % of the infiltrant material. In another instance, the body can include at most 70 vol % of the infiltrant material for the total volume of the body, such as at most 65 vol %, at most 60 vol %, at most 55 vol %, or at most 50 vol % of the infiltrant material. It is to be understood that the body can include the infiltrant material in a content including any of the minimum and maximum percentages disclosed herein. For example, the body of an abrasive component can include the infiltrant material in a content from at least 15 vol % to at most 70 vol %, such as from at least 20 vol % to at most 65 vol %.

According to another embodiment, the body can include a content of the infiltrant material of at least 10 wt % for a total weight of the body, such as at least 13 wt %, at least 20 wt %, at least 25 wt. %, at least 32 wt. %, at least 38 wt. %, at least 42 wt. %, or at least 45 wt. %. In another embodiment, the body can include a content of the infiltrant material of at most 50 wt. % for a total weight of the abrasive component, such as at most 45 wt. %, at most 41 wt. %, at most 38 wt. %, at most 32 wt. %, at most 28 wt. %, or at most 25 wt. %. In a further embodiment, the body can include the infiltrant material in a content of at least 10 wt. % and at most 45 wt. % of a total weight of the abrasive component body.

Figure 4:
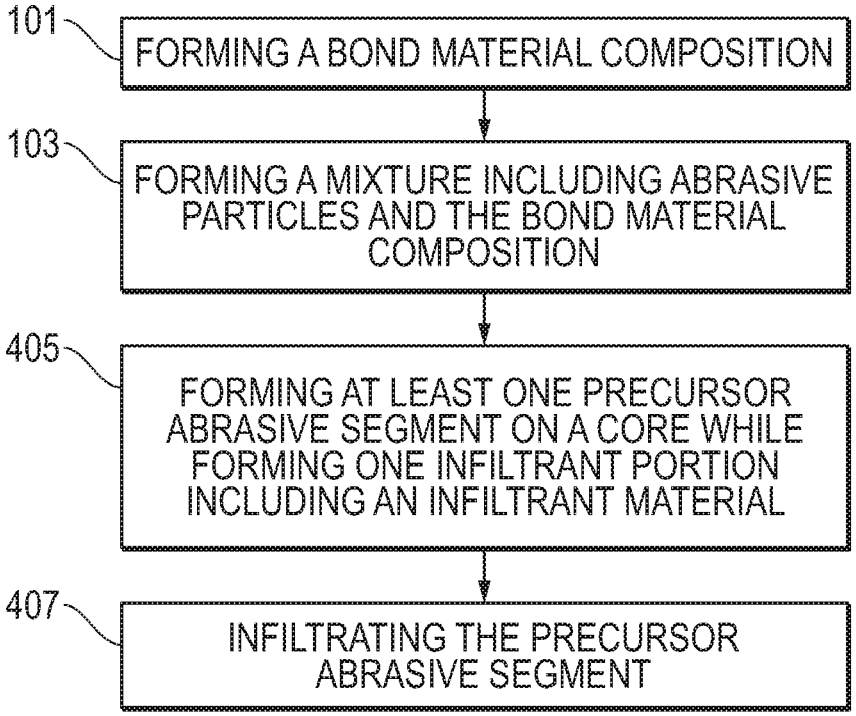
FIG. 4 includes a flow chart including a process in accordance with another embodiment.

FIG. 4 includes a flow chart illustrating an alternative process for forming an exemplary abrasive article. The process can include the same steps of 101 and 103 disclosed herein. At step 405, forming at least one precursor abrasive component on a core can be performed while forming at least one infiltrant portion including an infiltrant material.

According to an embodiment, to allow simultaneous formation of the precursor abrasive component and infiltrant portion, the infiltrant material can be applied to the mixture prior to a pressure is applied to the mixture as noted above. The infiltrant material can be in direct contact with the mixture. When formation of a plurality of precursor abrasive component is desired, a plurality of infiltrant portions may be formed simultaneously. Particularly, each precursor abrasive component s can be in contact with an infiltrant portion. After applying the infiltrant material to the mixture, the process can proceed with applying a pressure as noted above.

At step 409, after formation of the at least one precursor abrasive component and infiltrant portion, a heat can be applied to facilitate infiltrating the precursor abrasive component body. According to an embodiment, a heat can be applied to the at least one precursor abrasive component and the at least one infiltrant portion. Heating can be performed as noted above. After infiltration is completed, at least one abrasive segment on the core can be formed.

Figure 5:
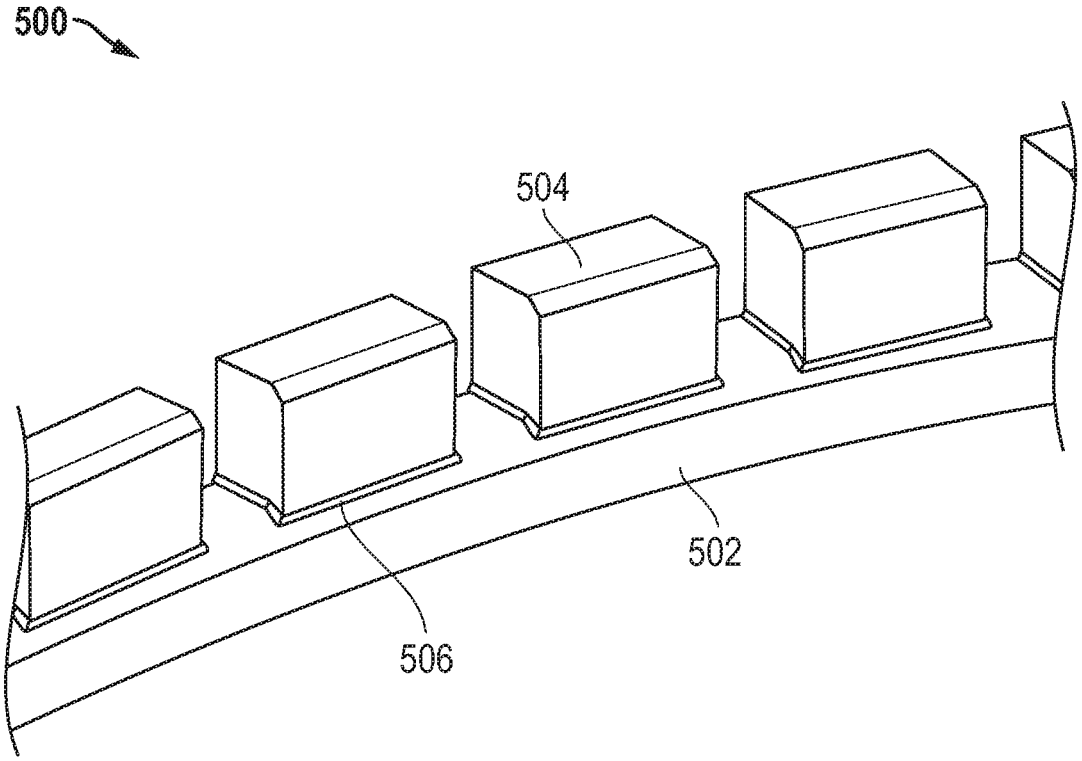
FIG. 5 includes an illustration of a portion of an exemplary abrasive article in accordance with an embodiment.
Figure 6:
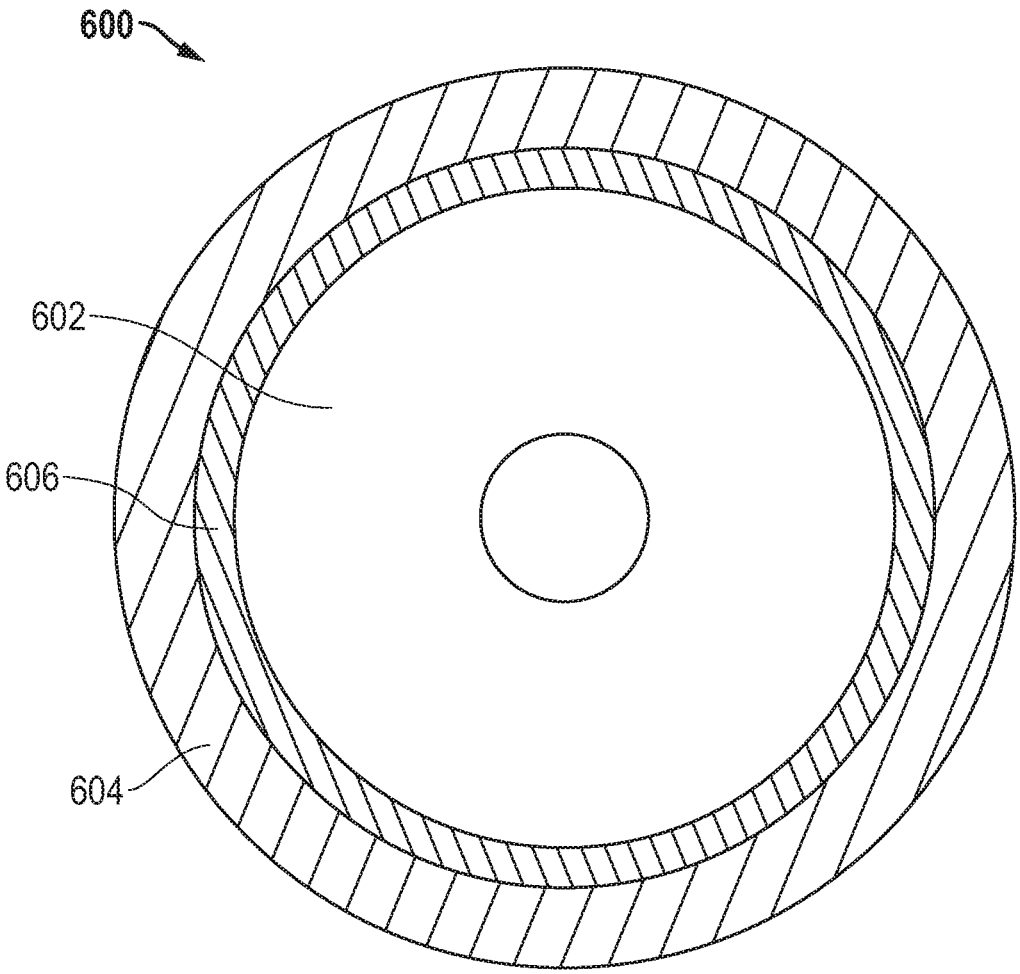
FIG. 6 includes an illustration of an exemplary abrasive article in accordance with another embodiment herein.
Figure 7:
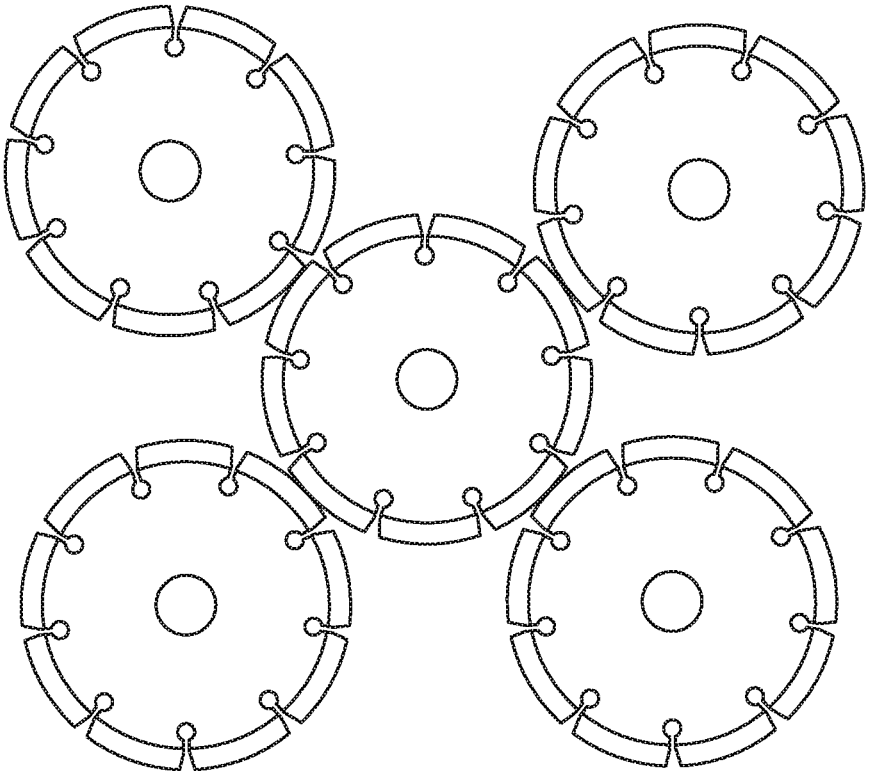
FIG. 7 includes an illustration of a cut-off blade in accordance with an embodiment.
Figure 8:
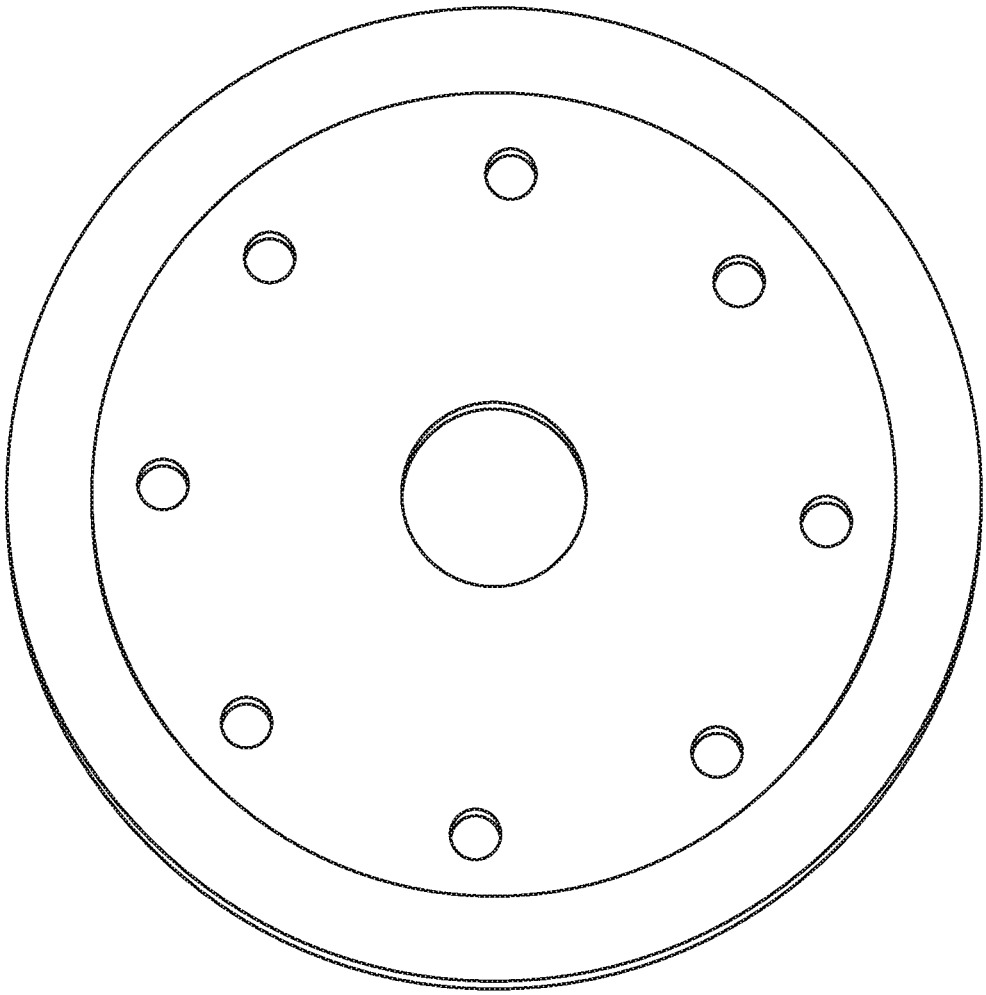
FIG. 8 includes an illustration of a cutting blade including a continuous rim in accordance with an embodiment.
Figure 9:
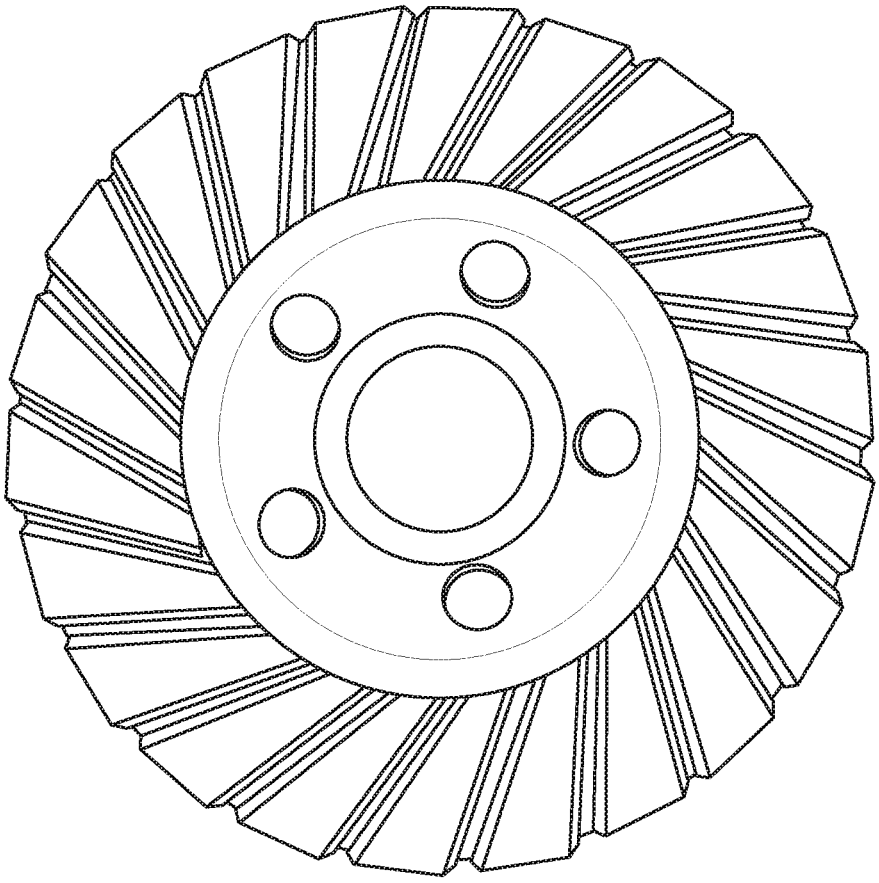
FIG. 9 includes an illustration of a cup wheel in accordance with an embodiment.
Figure 10:
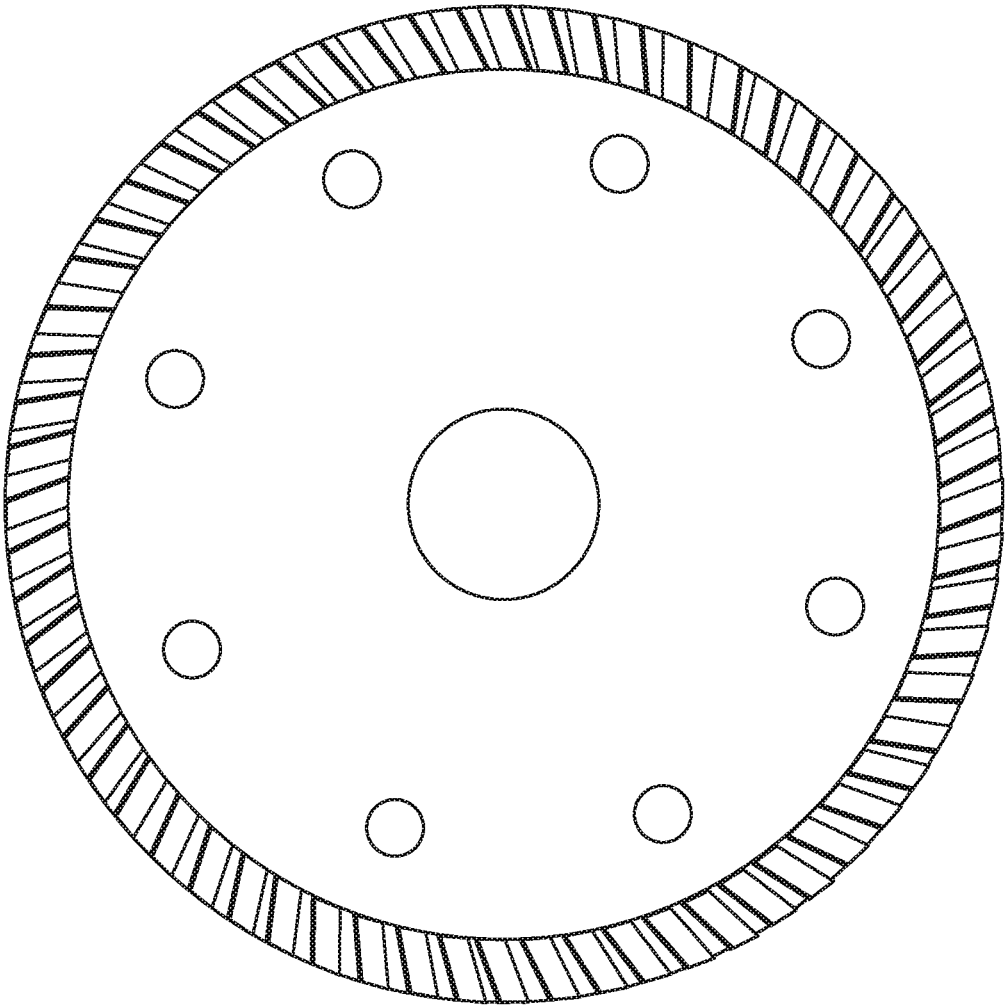
FIG. 10 includes an illustration of a turbo blade in accordance with an embodiment.

According to embodiments herein, the bonding region can form an identifiable interfacial layer that has a distinct phase from both the core and the abrasive component. The bonding region can include the infiltrant material. Particularly, the bonding region can have the same composition as the infiltrant material. FIG. 5 includes illustration of a portion of an abrasive article 500. The abrasive article 500 includes a core 502, bonding regions 506 and abrasive segments 504. FIG. 6 includes illustration of a portion of an abrasive article 600. The abrasive article 600 includes a core 602, bonding regions 606 and a continuous rim 604.

The abrasive article formed in accordance with embodiments herein can include abrasive tools having at least one abrasive component bonded to the core. Depending on the application, the abrasive article can be a tool including a plurality of abrasive segments bonded to the core. The abrasive article can also be a tool including a continuous rim bonded to the core. The abrasive article can be a cutting tool for cutting construction materials, such as a saw for cutting concrete. Alternatively, the abrasive tool can be a grinding tool such as for grinding concrete or fired clay or removing asphalt. FIGS. 7 to 10 include photographs of exemplary abrasive articles formed in accordance with embodiments herein. The articles are in the order of the figures, cut-off blade, a continuous blade, cup wheel, and a turbo blade.

Many different aspects and embodiments are possible. Some of those aspects and embodiments are described herein. After reading this specification, skilled artisans will appreciate that those aspects and embodiments are only illustrative and do not limit the scope of the present invention. Embodiments may be in accordance with any one or more of the embodiments as listed below.

Embodiment 1

A process, comprising: forming at least one precursor abrasive component on a core, the precursor abrasive component including a body having a metal bond matrix and abrasive particles contained within the metal bond matrix; and infiltrating at least a portion of the body after forming.

Embodiment 2

The process of embodiment 1, wherein infiltrating comprises applying an infiltrant material to at least a portion of the body, a portion of the core, or a portion of both.

Embodiment 3

The process of embodiments 1 or 2, further comprising heating at least a portion of the at least one precursor component.

Embodiment 4

The process of any one of embodiments 1 to 3, comprising forming at least one abrasive component on the core.

Embodiment 5

A process, comprising:

forming at least one precursor abrasive component on a core, the precursor abrasive component including a body having a metal bond matrix and abrasive particles contained within the metal bond matrix;

forming at least one infiltrant portion including an infiltrant material while forming the at least one precursor abrasive component; and heating the at least one precursor abrasive segment and the at least one infiltrant portion to infiltrate the precursor abrasive component with the infiltrant material and forming at least one abrasive component on the core.

Embodiment 6

The process of any one of embodiments 1 to 5, wherein forming the precursor abrasive component on the core comprises simultaneous formation of the body and joining of the precursor abrasive component to the core.

Embodiment 7

The process of any one of embodiments 2 to 6, wherein the infiltrant material comprises a metal or a metal alloy.

Embodiment 8

The process of any one of embodiments 2 to 7, wherein the infiltrant material consists essentially of a metal or metal alloy.

Embodiment 9

The process of any one of embodiments 2 to 8, wherein the infiltrant material comprises a transition metal element, an alloy including a transition metal element, or a combination thereof.

Embodiment 10

The process of any one of embodiments 2 to 9, wherein the infiltrant material comprises Zn, Sn, Cu, Ag, Ni, Cr, Mn, Fe, Al, or any combination thereof.

Embodiment 11

The process of any one of embodiments 3 to 10, wherein heating is performed at a temperature of at least a melting temperature of the infiltrant material.

Embodiment 12

The process of any one of embodiments 3 to 11, wherein heating is performed at a temperature of at least 600° C., at least 700° C., at least 800° C., at least 860° C., at least 900° C., at least 920° C., at least 960° C., or at least 1000° C.

Embodiment 13

The process of any one of embodiments 3 to 12, wherein heating is performed at a temperature of at most of 1320° C., at most of 1260° C., at most of 1180° C., at most of 1120° C., or at most of 1050° C.

Embodiment 14

The process of any one of embodiments 3 to 13, wherein heating is performed at a temperature in a range including at least 860° C. and at most of 1320° C., in a range including at least 900° C. and at most of 1260° C., in a range including at least 920° C. and at most of 1180° C., in a range including at least 960° C. and at most of 1120° C., or in a range including at least 980° C. and at most of 1050° C.

Embodiment 15

The process of any one of embodiments 3 to 14, wherein heating is performed in a reducing atmosphere, an inert atmosphere, or an ambient atmosphere.

Embodiment 16

The process of any one of embodiments 1 to 15, further comprising forming a mixture including a metal bond material and the abrasive particles.

Embodiment 17

The process of any one of embodiments 1 to 16, wherein the metal bond matrix comprises a metal element or an alloy.

Embodiment 18

The process of any one of embodiments 1 to 17, wherein the metal bond matrix comprises a transition metal element.

Embodiment 19

The process of any one of embodiments 16 to 18, wherein forming at least one precursor abrasive component on the core comprises applying a pressure to the mixture.

Embodiment 20

The process of any one of embodiments 1 to 19, wherein forming at least one precursor abrasive component on the core comprises a single pressing operation.

Embodiment 21

The process of any one of embodiments 1 to 20, wherein forming at least one precursor abrasive component on the core comprises cold pressing.

Embodiment 22

The process of embodiments 20 or 21, wherein pressing is performed at a pressure of at least 100 MPa, at least 200 MPa, at least 300 MPa, at least 400 MPa, at least 500 MPa, at least 700 MPa, or at least 900 MPa.

Embodiment 23

The process of any one of embodiments 20 to 22, wherein pressing is performed at a pressure of at most 3000 MPa, at most 2500 MPa, at most 2250 MPa, at most 1850 MPa, or at most 1500 MPa.

Embodiment 24

The process of any one of embodiments 20 to 23, wherein pressing is performed at a pressure in a range including at least 100 MPa and at most 3000 MPa, or in a range including at least 100 MPa and at most 1500 MPa.

Embodiment 25

The process of any one of embodiments 20 to 24, wherein pressing is performed at a temperature of at most 200° C., at most 165° C., at most 115° C., or at most 50° C.

Embodiment 26

The process of any one of embodiments 20 to 25, wherein pressing is performed in an ambient atmosphere, a reducing atmosphere, or an inert atmosphere.

Embodiment 27

The process of any one of embodiments 1 to 26, wherein the body of the precursor abrasive component comprises a porosity of at least 10% for a total volume of the body, such as at least 13 vol %, at least 20 vol %, at least 28 vol %, at least 34 vol %, at least 42 vol %, at least 48 vol %, or at least 50 vol %.

Embodiment 28

The process of any one of embodiments 1 to 27, wherein the body of the precursor abrasive component comprises a porosity of at most 50 vol % for a total volume of the body, such as at most 46 vol %, at most 43 vol %, at most 38 vol %, at most 33 vol %, at most 28 vol %, or at most 20 vol %.

Embodiment 29

The process of any one of embodiments 1 to 28, wherein the body of the precursor abrasive component comprises a content of the abrasive particles of at least 2 vol % for a total volume of the body, such as at least 7.5 vol %, at least 12.5 vol %, at least 20 vol %, at least 27.5 vol %, or at least 35 vol %.

Embodiment 30

The process of any one of embodiments 1 to 29, wherein the body of the precursor abrasive component comprises a content of the abrasive particles of at most 50 vol % for a total volume of the body, such as at most 45 vol %, at most 37.5 vol %, at most 33.5 vol %, or at most 30 vol %.

Embodiment 31

The process of any one of embodiments 1 to 30, wherein the abrasive particles comprises a superabrasive including diamond, cubic boron nitride, or any combination thereof.

Embodiment 32

The process of any one of embodiments 1 to 31, wherein the body of the precursor abrasive component comprises a content of the metal bond matrix of at least 20 vol % for a total volume of the body, such as, at least 27.5 vol %, at least 35 vol %, or at least 40 vol %.

Embodiment 33

The process of any one of embodiments 1 to 32, wherein the body of the precursor abrasive component comprises a content of the metal bond matrix of at most 60 vol % for a total volume of the body, such as at most 52 vol %, at most 48 vol %, or at least 40 vol %.

Embodiment 34

The process of any one of embodiments 3 to 33, wherein the abrasive segment comprises a content of the abrasive particles in a range between 2 vol % to 50 vol %.

Embodiment 35

The process of any one of embodiments 3 to 34, wherein the abrasive segment comprises a content of the infiltrant material of at least 10 wt. % for a total weight of the abrasive component, such as at least 13 wt. %, at least 16 wt. %, at least 18 wt. %, at least 23 wt. %.

Embodiment 36

The process of any one of embodiments 3 to 35, wherein the abrasive segment comprises a content of the infiltrant material of at most 45 wt. % for a total weight of the abrasive component, at most 41 wt. %, at most 38 wt. %, at most 32 wt. %, at most 28 wt. %, or at most 25 wt. %.

Embodiment 37

The process of any one of embodiments 3 to 36, wherein the abrasive segment comprises a content of the metal bond matrix of at least 15 wt. % for a total weight of the abrasive component, such as at least 20 wt. %, at least 22 wt. %, or at least 25 wt. %.

Embodiment 38

The process of any one of embodiments 3 to 37, wherein the abrasive component comprises a content of the metal bond matrix of at most 45 wt. % for a total weight of the abrasive component, such as at most 40 wt. %, at most 35 wt. %, or at most 30 wt. %.

Embodiment 39

The process of any one of embodiments 3 to 38, wherein the abrasive component comprises a content of the abrasive particles of at least 2 wt. % for a total weight of the abrasive component, at least 5 wt. %, at least 7 wt. %, or at least 10 wt. %.

Embodiment 40

The process of any one of embodiments 3 to 39, wherein the abrasive component comprises a content of the abrasive particles of at most 15 wt. % for a total weight of the abrasive component, at most 10 wt. %, at most 7 wt. %, or at most 5 wt. %.

Embodiment 41

The process of any one of embodiments 3 to 40, wherein the abrasive component comprises a porosity of at most 5 vol %, at most 4 vol %, or at most 3 vol %.

The present embodiments represent a departure from the state of the art. Notably, embodiments herein are related to streamlined processes for forming an abrasive article, such as a cut-off blade and cut wheel. The abrasive articles formed in accordance with embodiments herein can have better mechanical strength and be more resistant to destruction or breakage between the core and abrasive segment of abrasive articles. Representative cut-off blades and cup wheels demonstrated comparable cutting and grinding performance as compared to corresponding tools formed using conventional methods, such as brazing and laser welding, and better performance compared to tools formed by sintering.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive. Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other teachings can certainly be used in this application.

As used herein, the terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in reference books and other sources within the structural arts and corresponding manufacturing arts.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A process, comprising:

forming at least one precursor abrasive component on a core, the precursor abrasive component including a body having a metal bond matrix and abrasive particles contained within the metal bond matrix, wherein the body of the precursor abrasive component comprises:

a porosity of at least 10% and at most 50 vol % for a total volume of the body a content of the abrasive particles of at least 2 vol % and at most 50 vol % for the total volume of the body; and a content of the metal bond matrix of at least 20 vol % and at most 60 vol % for the total volume of the body; and infiltrating at least a portion of the body after forming, wherein forming the at least one precursor abrasive component on the core comprises simultaneous formation of the body of the at least one precursor abrasive component and joining of the at least one precursor abrasive component to the core.

2. The process of claim 1, wherein forming the precursor abrasive component on the core comprises simultaneous formation of bodies of a plurality of precursor abrasive components and joining of the plurality of precursor abrasive components directly to the core.

3. The process of claim 1, wherein infiltrating comprises applying an infiltrant material to at least a portion of the body, a portion of the core, or a portion of both.

4. The process of claim 3, wherein the infiltrant material comprises a metal element, a metal alloy, or a combination thereof.

5. The process of claim 3, further comprising heating at least a portion of the at least one precursor component.

6. The process of claim 5, wherein heating is performed at a temperature of at least a melting temperature of the infiltrant material.

7. The process of claim 1, wherein forming at least one precursor abrasive component on the core comprises applying a pressure to a mixture including a metal bond material and the abrasive particles.

8. The process of claim 2, wherein forming at least one precursor abrasive component on the core comprises a single pressing operation.

9. The process of claim 1, wherein the abrasive particles comprise a superabrasive including diamond, cubic boron nitride, or any combination thereof.

10. The process of claim 1, further comprising forming at least one abrasive component on the core.

11. A process, comprising:

forming at least one precursor abrasive component on a core, the precursor abrasive component including a body having a metal bond matrix and abrasive particles contained within the metal bond matrix, wherein forming the at least one precursor abrasive component on the core comprises simultaneous formation of the body of the at least one precursor abrasive component and joining of the precursor abrasive component to the core, wherein the body of the precursor abrasive component comprises:

a porosity of at least 10% and at most 50 vol % for a total volume of the body a content of the abrasive particles of at least 2 vol % and at most 50 vol % for the total volume of the body; and a content of the metal bond matrix of at least 20 vol % and at most 60 vol % for the total volume of the body;

forming at least one infiltrant portion including an infiltrant material while forming the at least one precursor abrasive component; and heating the at least one precursor abrasive segment and the at least one infiltrant portion to infiltrate the precursor abrasive component with the infiltrant material and forming at least one abrasive component on the core.

12. The process of claim 11, wherein forming the precursor abrasive component on the core comprises simultaneous formation of bodies of a plurality of precursor abrasive components and joining of the plurality of precursor abrasive components to the core.

13. The process of claim 11, wherein the infiltrant material comprises a transition metal element, an alloy including a transition metal element, or a combination thereof.

14. The process of claim 11, wherein heating is performed at a temperature of at least a melting temperature of the infiltrant material.

15. The process of claim 12, wherein forming at least one precursor abrasive component on the core comprises a single pressing operation.

16. The process of claim 11, wherein forming at least one precursor abrasive component on the core comprises cold pressing.

17. The process of claim 15, wherein pressing is performed at a pressure in a range including at least 100 MPa and at most 3000 MPa.

18. The process of claim 11, wherein the abrasive component comprises a content of the infiltrant material of at least 10 wt. % and at most 45 wt. % for a total weight of the abrasive component.

19. The process of claim 11, wherein the abrasive component comprises a porosity of at most 5 vol % and a content of the abrasive particles in a range between 2 vol % to 50 vol % for a total volume of the abrasive component.

* * * * *